US010174652B2

(12) United States Patent
Von Drathen et al.

(10) Patent No.: US 10,174,652 B2
(45) Date of Patent: Jan. 8, 2019

(54) EMISSION SIGNATURE MODIFICATION DEVICE

(71) Applicant: MTU FRIEDRICHSHAFEN GMBH, Friedrichshafen (DE)

(72) Inventors: Arndt Von Drathen, Friedrichshafen (DE); Hubert Ohmayer, Oberteuringen (DE); Hennig Böhle, Kressbronn (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 15/500,790

(22) PCT Filed: Aug. 4, 2015

(86) PCT No.: PCT/EP2015/001599
§ 371 (c)(1),
(2) Date: Jan. 31, 2017

(87) PCT Pub. No.: WO2016/066235
PCT Pub. Date: May 6, 2016

(65) Prior Publication Data

US 2017/0218805 A1 Aug. 3, 2017

(30) Foreign Application Priority Data

Oct. 27, 2014 (DE) ..... 10 2014 015 762

(51) Int. Cl.
*F01N 1/06* (2006.01)
*F01N 3/02* (2006.01)

(52) U.S. Cl.
CPC ..... *F01N 1/065* (2013.01); *F01N 3/02* (2013.01); *F01N 2230/00* (2013.01);
(Continued)

(58) Field of Classification Search
CPC ..... F01N 1/06; F01N 3/02; F01N 2230/00; F01N 2260/02; F01N 2270/02; F01N 2470/08
(Continued)

(56) References Cited

U.S. PATENT DOCUMENTS 6,839,439 B2 1/2005 Daly
9,260,997 B2 * 2/2016 Daikoku ..... F01N 3/046
2001/0021258 A1 * 9/2001 Nagel ..... F01N 1/065 381/71.4

FOREIGN PATENT DOCUMENTS

DE 19832979 C1 11/1999
DE 10304778 A1 9/2003
(Continued)

*Primary Examiner* — Laert Dounis
*Assistant Examiner* — Kelsey L Stanek
(74) *Attorney, Agent, or Firm* — Lucas & Mercanti, LLP; Klaus P. Stoffel

(57) ABSTRACT

An emission signature modification device for modifying an acoustic signature of an exhaust gas stream, including an exhaust gas guiding device that guides the exhaust gas stream in the flow direction thereof from an inlet area to an outlet area. An active acoustic emission modification device modifies the acoustic emission of the exhaust gas stream in predetermined operating states. If an actuator system of the active acoustic emission modification device is designed such that in a circumferential direction, the actuator system is surrounded by more than 30% of the guided exhaust gas stream, the actuating system can be protected against harmful influences from the environment by way of the exhaust gas guiding device on the one hand, and on the other hand, the required space signifier can be reduced as compared to a lateral, external arrangement of the actuating system.

10 Claims, 1 Drawing Sheet

(52) U.S. Cl.
CPC ..... *F01N 2260/02* (2013.01); *F01N 2270/02* (2013.01); *F01N 2470/08* (2013.01)

(58) Field of Classification Search
USPC ..... 60/320
See application file for complete search history.

(56) References Cited

FOREIGN PATENT DOCUMENTS

| | | | |
|---|---|---|---|
| JP | 2006249947 | A | 9/2006 |
| WO | 0005489 | A1 | 2/2000 |
| WO | 2009099399 | A1 | 8/2009 |

* cited by examiner

EMISSION SIGNATURE MODIFICATION DEVICE

The present application is a 371 of International application PCT/EP2015/001599, filed Aug. 4, 2015, which claims priority of DE 10 2014 015 762.8, filed Oct. 27, 2014, the priority of these applications is hereby claimed and these applications are incorporated herein by reference.

BACKGROUND OF THE INVENTION

The invention relates to an emission signature modification device at least for the modification of an acoustic signature of an exhaust gas stream, comprising an exhaust gas guiding device, by means of which the exhaust gas stream is guided in the flow direction thereof from an inlet region to an outlet region, and comprising an active acoustic emission modification device, by means of which the acoustic emission of the exhaust gas stream is modified in predetermined operating states.

Exhaust gas noises of internal combustion engines can be modified by exhaust mufflers in accordance with the absorption principle or the reflection principle or by a combination of the two types, for example. In addition, it is possible to use active acoustic emission modification devices which operate on the principle of interference. Active systems of this kind can be used to reduce exhaust gas noises or, alternatively, to modify the exhaust gas noise in order to achieve a desired sound of the exhaust system. This is accomplished by selective reduction or amplification of selected frequency components. Such selective alteration of selected frequency components is preferably used in the motor vehicle industry in order to obtain the desired sound effect of the exhaust system. In this context, the active components, referred to as the "actuator system", are usually mounted externally on the side of the pipes through which the exhaust gas flows or are coupled to the exhaust line with the aid of blind tube sections. This structural separation between the actuator system and the region carrying the exhaust gas is necessary because the hot exhaust gases and the associated high temperature level cause the actuator system to wear more quickly in the long term. At the same time, however, coupling the actuator system externally on the side necessitates additional installation space for this system. Moreover, cooling is advantageous to enable the thermal stress on the actuator system to be reduced, and a corrosion-resistant design of the actuator system should be provided owing to the corrosive properties of the exhaust gases.

However, despite appropriate design measures, there has been inadequate success in ensuring less impairment by the exhaust gas temperature and ensuring corrosion resistance of the actuator system in such a way that the service life can be significantly improved. Moreover, an actuator system mounted on the side of the exhaust gas guiding device in this way is exposed largely unprotected to external influences, and therefore damage to the actuator system can occur.

SUMMARY OF THE INVENTION

The present invention is concerned with the problem of specifying an improved or at least an alternative embodiment for an emission signature modification device, which embodiment is distinguished especially by a long service life and by a low installation space requirement.

According to one aspect of the invention, an emission modification device is proposed at least for the modification of an acoustic signature of an exhaust gas stream, comprising an exhaust gas guiding device, by means of which the exhaust gas stream is guided in the flow direction thereof from an inlet region to an outlet region, and comprising an active acoustic emission modification device, by means of which the acoustic emission of the exhaust gas stream is modified in predetermined operating states. In this case, more than 30% of an actuator system of the active acoustic emission modification device can be surrounded in a circumferential direction by the guided exhaust gas stream.

It is also possible for more than 50%, in particular more than 60%, optionally more than 70%, and even more than 80% for example, of the actuator system of the active acoustic emission modification device to be surrounded in a circumferential direction by the guided exhaust gas stream.

By means of such a design embodiment and positioning of the actuator system, it is advantageously possible to significantly reduce the installation space requirement for an active acoustic emission modification device since the actuator system does not have to be mounted externally on the side of the pipes through which the exhaust gas flows but is designed so as to be surrounded at least partially by the exhaust gas guiding device or by the exhaust gas stream. As a result, the emission signature modification device can be made more compact and, in addition, the actuator system is protected from external influences by the at least partially surrounding design of the exhaust gas guiding device, thereby making it possible to significantly reduce damage to the actuator system by external influences. Thus, by virtue of the surrounding arrangement, the exhaust gas guiding device acts as a containment-type protection for the actuator system. By means of such positioning of the actuator system within the exhaust gas guiding device, it is advantageously likewise possible for the entire acoustic emission modification device to be surrounded in a protective way by the exhaust gas stream or by the exhaust gas guiding device.

Here, an emission signature is taken to mean any type of signature which can be produced by emissions of an exhaust gas stream. Accordingly, the term emission signature includes a heat signature, an acoustic signature, a pollutant signature or some other emission signature, for example.

Accordingly, an emission signature modification device is a modification device by means of which emission signatures of any desired kind can be modified in a desired way. For example, modification of an acoustic signature can be taken to mean any desired alteration of the signature of the acoustic emission, thus for example a wide-band sound reduction or a reduction of the amplitude in selected acoustic frequency ranges as well as an increase in the amplitude in other selected acoustic frequency ranges.

An exhaust gas guiding device, by means of which an exhaust gas stream, e.g. that of an internal combustion engine, is guided in a desired manner, can be taken to mean an exhaust section or an exhaust line, for example, wherein the exhaust section or the exhaust line can also have a heat exchanger, or, alternatively, a complex system of tube bundles, deflection plates, impingement separators or the like. By means of the abovementioned exhaust gas guiding elements, of which the list is not exhaustive, the exhaust gas can be guided in the flow direction thereof from an inlet region to an outlet region.

Here, an inlet region of the emission signature modification device is taken to mean the region in which the exhaust gas stream is fed to the emission signature modification device. The outlet region of the emission signature modification device should be taken to mean the region in which the exhaust gas stream is released into the environment or in which the exhaust gas stream is introduced into a subsequent exhaust gas guiding section.

As an overarching definition, the flow direction of the exhaust gas stream is defined as the direction from the inlet region to the outlet region, irrespective of the actual flow direction within the exhaust gas guiding device. Any deflections of the flow direction of the exhaust gas stream within the exhaust gas guiding device remain negligible as regards the above-described determination of the flow direction of the exhaust gas stream.

An active acoustic emission modification device should be taken to mean a device by means of which the sound waves of the exhaust gas stream or the acoustic emission can be actively modified by sound radiation in a desired manner. Here, the active acoustic emission modification device produces sound in such a way that the acoustic emission of the exhaust gas is modified in a desired manner by interference.

Here, it may be that such an active acoustic emission modification is performed only in predetermined operating states, while no active acoustic emission modification is performed in other operating states. It is also conceivable for active acoustic emission modification to be performed in all operating states.

An actuator system of the active acoustic emission modification device is taken to mean one or more transducers which convert electronic signals into a mechanical movement, wherein sound is produced by the converted mechanical movement, optionally also in interaction with other components of the active acoustic emission modification device, and this sound interacts with soundwaves of the exhaust gas stream to produce a modification of the acoustic emission of the exhaust gas stream.

The circumferential direction in the region of the actuator system should be taken to mean the edge at which a surface aligned perpendicularly to the flow direction and passing through the actuator system intersects the shell of the emission signature modification device. In this circumferential direction in the region of the actuator system, more than 30% of said system is surrounded by the guided exhaust gas stream. Here, the percentage indication in the circumferential direction relates to a circular angle of 360°, which corresponds to 100%. Thus, in the case of a surrounding exhaust gas stream covering more than 50%, the actuator system would be surrounded by the exhaust gas stream at least over a circular angle of 180°. Here, the region surrounded by the exhaust gas stream can also be of discontinuous design in the circumferential direction. In this case, only the region through which the exhaust gas stream flows is used in calculating the percentage.

Moreover, the exhaust gas stream can be passed at least partially through an outer shell of the exhaust gas guiding device. This advantageously enables the outer shell to be used for guiding and simultaneously also for cooling the exhaust gas stream since the outer shell can give off at least some of the heat of the exhaust gas stream to the environment.

Here, an outer shell of the exhaust gas guiding device is taken to mean the pipe wall or, alternatively, the outermost wall of the exhaust gas guiding device, for example, said wall coming into contact with the environment. In this case, any containment-type protection which is mounted on the outermost shell and is not directly associated with the exhaust gas guiding device can be ignored.

Moreover, the exhaust gas stream is guided at least partially between the outer shell and an inner shell of the exhaust gas guiding device. It is thereby advantageously possible to enlarge the area of the exhaust gas guiding device which gives off heat to the environment by virtue of the guidance of the exhaust gas stream in such a way along the boundary. Moreover, an inner region of the exhaust gas guiding device can advantageously be configured so as to be free from the exhaust gas stream. This makes it possible to position possibly sensitive components in this inner region of the exhaust gas guiding device since they are protected from damaging effects of the exhaust gas stream. It is also conceivable here that the respective shell is of multi-ply design.

If at least one of the shells is designed for a flow of fluid through at least a segment or segments, it is advantageously possible for heat to be removed from the exhaust gas stream at least by the shell through a segment or segments of which the fluid flows. By means of an embodiment of this kind, it is thereby possible to modify or reduce the heat signature of the exhaust gas stream in an advantageous way. Moreover, it is not necessary for the fluid to flow through the entirety of the respective shell; instead it can be designed for such fluid throughflow in a segment or segments or in predetermined regions.

Here, a segment or segments can be taken to mean a segment in a circumferential direction, in the flow direction or in any other direction.

If the extent of the inner shell amounts to at least 1% of the extent of the outer shell in the flow direction, it is advantageously possible for the inner shell to have a smaller extent at the end than the outer shell. It is thereby advantageously possible to create a space without an inner shell in the outlet region, thus allowing the soundwaves of the active acoustic emission modification device to come into direct contact with the acoustic emission of the exhaust gas and allowing them to interact in a desired manner without being hindered by the inner shell.

Here, an extent of the respective shell in the flow direction is taken to mean the distance, starting from the inlet region, over which the respective shell extends toward the outlet region.

It is also possible for the extent of the inner shell to amount to at least 5% of the extent of the outer shell, in particular at least 10%, optionally at least 20%, and at least 50%, for example.

Moreover, at least one component which is arranged within the outer shell and guides the exhaust gas stream can be provided, and there can likewise be a flow of fluid through said component. It is advantageously possible by means of such components, e.g. an impingement separator or baffles, to reduce other emissions of the exhaust gas. It is likewise conceivable to use components of this kind to produce vortex flows in the exhaust gas, and these can likewise lead to a modification of the emission signature, e.g. of the acoustic signature or of the heat signature.

In this case, a component which guides the exhaust gas stream is taken to mean a component which is in direct contact with the exhaust gas stream and causes an at least partial change in direction of the exhaust gas stream.

A cross-sectional area of the outlet region perpendicular to the flow direction can furthermore be at most 90% smaller than a central cross-sectional area of the emission signature modification device perpendicular to the flow direction. By means of such a design of the cross-sectional areas, it is advantageously possible to make the cross-sectional area in the outlet region and within the emission signature modification device, which actually guide the exhaust gas, approximately the same size, thus, on the one hand, enabling the required installation space in the region of the outlet region to be reduced and, on the other hand, ensuring that the central widening of the emission signature modification device does not exert any negative effects in other respects.

In this case, the cross-sectional area of the outlet region perpendicular to the flow direction can also be at most 80% smaller than the central cross-sectional area figures, in particular by at most 60%, optionally by at most 40%, and by at most 20% for example.

If the emission signature modification device is designed at least for the modification of a heat signature of an exhaust gas stream, it is advantageously possible to use the emission signature modification device also to influence the heat signature of the exhaust gas stream in a desired manner. This is advantageous, for example, when the heat signature of the exhaust gas stream makes it possible to locate a submarine, a surface ship, a motor vehicle or a rail-bound motor vehicle, for example. If the heat signature of the exhaust gas stream is accordingly modified in such a way that location is no longer possible and if this is combined with corresponding modification of the acoustic signature, for example, the possibility of location and a noise level of the respective vehicle type are significantly reduced.

If the heat emission modification device has a cooling device having a first cooling fluid, the modification of the heat signature of the exhaust gas stream can also be carried out efficiently at relatively high exhaust gas mass flows without the possibility of an unwanted heat signature occurring when heat spikes arise, for example. In this context, water or seawater, in the case of a marine use for example, can be used as the first cooling fluid, for example. Precisely where seawater is available, particularly efficient modification of the heat emission within a wide operating range is possible without the need to carry a first cooling fluid as a separate working medium.

If the cooling device is formed at least partially by a shell through which there is a fluid flow, it is likewise advantageously possible for heat to be removed from the exhaust gas by means of the shell through which fluid flows.

If a cooling device having a second cooling fluid is advantageously provided, by means of which the actuator system can be cooled, the second cooling device can advantageously be used to protect the actuator system from being exposed to heat by the hot exhaust gas stream, thus enabling the service life of the actuator system to be significantly extended. It is thereby possible to arrange the actuator system so as to be at least partially surrounded by the exhaust gas stream without the actuator system wearing out more quickly due to the heat input caused by means of the exhaust gas stream.

If the first cooling device is fluidically connected to the second cooling device and, accordingly, only one cooling fluid is provided, it is possible to use just one cooling device both to modify the exhaust gas stream in respect of its heat signature and furthermore to cool the actuator system by means of a circuit and by means of the same cooling fluid and, accordingly, to extend the service life thereof.

If an acoustic diaphragm, driven by the actuator system, of the active acoustic emission modification device is of water-resistant, in particular seawater-resistant, design, it is possible, in respect of the acoustic diaphragm too, to significantly extend the service life of the active acoustic emission modification device overall. Particularly in the case of a marine use, in which the respective cooling fluid is optionally formed by seawater, corrosion by seawater can be significantly reduced.

If the emission signature modification device is designed as a separate subassembly, which, in the flow direction, is positioned centrally or at the end on an exhaust section, it is advantageously possible for the entire subassembly to be exchanged, in the case of a fault for example, and to be replaced by a correctly functioning subassembly.

However, it is also conceivable for the emission signature modification device to be formed integrally with the exhaust section, e.g. by means of welded joints. Here, a separate subassembly is taken to mean a subassembly which is connected to the other parts of the exhaust section by nonpositive or positive connection. However, it is also conceivable for the emission signature modification device to be arranged centrally or eccentrically in respect of a cross section perpendicular to the flow direction.

Of the figures, each of which is schematic:

DETAILED DESCRIPTION OF THE INVENTION

Figures 1, 2:
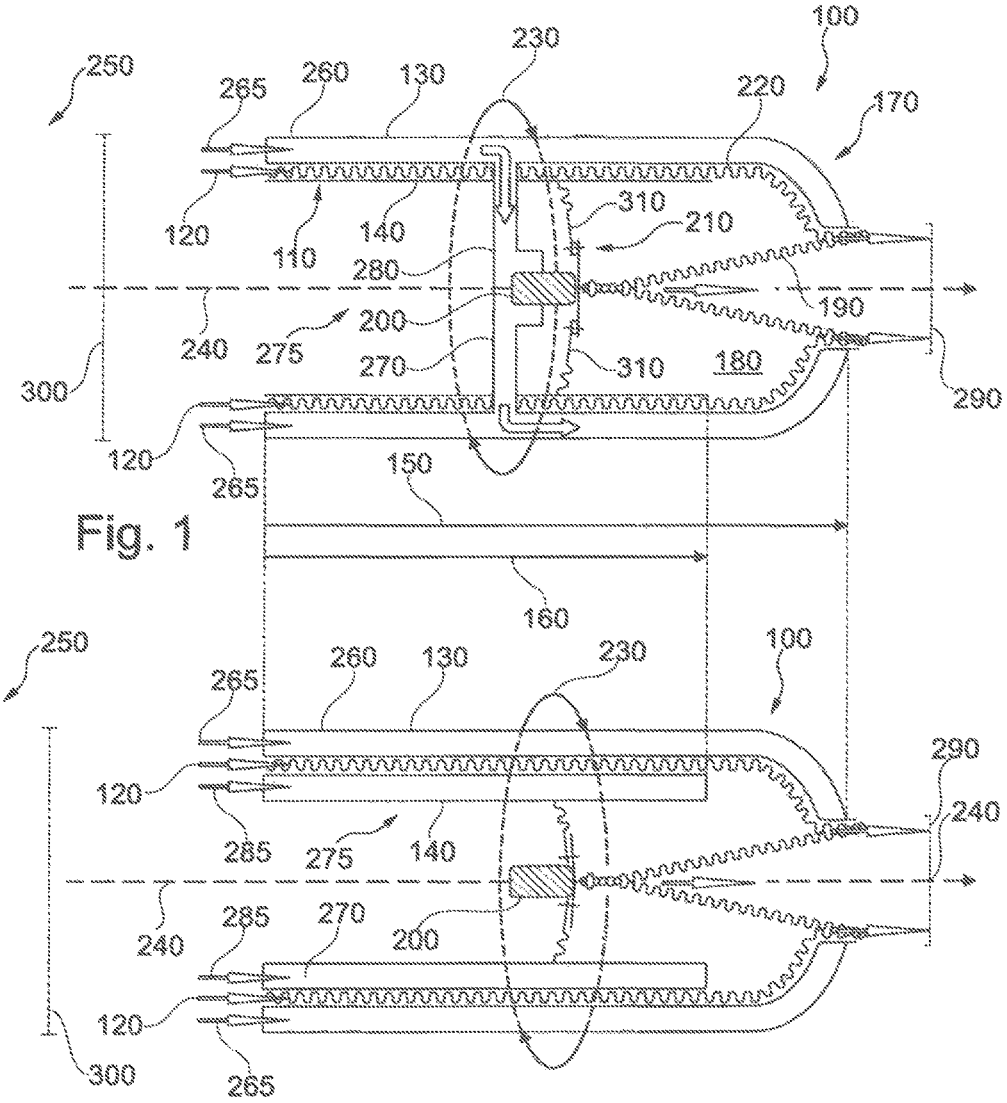
FIG. 1 shows an emission signature modification device having an internal actuator system and a second cooling device, which cools the actuator system.
FIG. 2 shows an emission signature modification device having an outer shell, through which fluid flows, and an inner shell, through which fluid flows.

As shown in FIG. 1, the emission signature modification device 100 has an exhaust gas guiding device 110, which guides an exhaust gas stream 120 at least in one segment or segments between an outer shell 130 and an inner shell 140.

Here, an extent 150 of the outer shell 130 is made larger than an extent 160 of the inner shell 140. Accordingly, a region 180 which is free from the inner shell 140 is formed in an outlet region 170 of the emission signature modification device 100. In this region 180, soundwaves 190 produced by the movement of an actuator system 200 of an active acoustic emission modification device 210 can enter into interaction directly with the acoustic emission 220 of the exhaust gas stream 120, thus allowing a desired modification of the acoustic signature to be established. By virtue of the design, the actuator system 200 is surrounded in a circumferential direction 230 at least segmentally by an exhaust gas stream 120. By virtue of this arrangement of the actuator system 200, which is central in relation to the flow direction 240, the required installation space for the active acoustic emission modification device 210 is reduced, on the one hand, and the active acoustic emission modification device 210 is protected by the exhaust gas guiding device 110 from the external effects due to the environment, on the other hand. Here, the flow direction 240 extends from an inlet region 250 (not shown in FIGS. 1 and 2) to the outlet region 170.

In the embodiment according to FIG. 1, the outer shell 130 is designed for a fluid throughflow, while the inner shell 140 is formed merely by a tubular plate or the like, for example. Thus, the outer shell 130 forms a first cooling device 260. By means of this first cooling device 260, the heat signature of the exhaust gas stream 120 can be modified in a desired manner by means of at least one first cooling fluid 265, which circulates in the outer shell 130, through which the fluid flows. In this arrangement, the inner shell 140 is designed merely as a tubular plate, thus allowing the exhaust gas stream to be guided by both shells 130, 140 in the gap between the outer shell 130 and the inner shell 140.

Moreover, a second cooling device 270 of a heat emission modification device 275 is provided, by means of which the actuator system 200 can be cooled. This second cooling device 270 is designed as a branch 280 from the first cooling device 260, wherein the fluid flowing through the outer shell 130 is guided to the actuator by means of the branch 280, with the result that the actuator system 200 is cooled by the first cooling fluid 265 of the first cooling device 260 and by means of the second cooling device 270. Accordingly, the first cooling device 260 is fluidically connected to the second cooling device 270. However, it is also conceivable for the second cooling device 270 to contain a separate second cooling fluid 285, while the first cooling device 260 is operated with a different first cooling fluid 265 as a working medium.

A cross-sectional area 290 of the outlet region 170 perpendicular and transverse to the flow direction 240 is made smaller than a central cross-sectional area 300 perpendicular to the flow direction 240. Accordingly, the exhaust gas stream 120 guided along the boundary or adjacent to the shell is brought back together again in the outlet region 170 in such a way that disadvantages relating to flow and those of other kinds are avoided.

An acoustic diaphragm 310 of the active acoustic emission modification device 210 is driven by the actuator system 200 in such a way that the soundwaves 190 can be radiated in a desired manner.

In the embodiment in FIG. 2, the cooling of the actuator system 200 is ensured by means of an inner shell 140, through which there is an additional fluid flow. In this case, the first cooling device 260 can be designed to be fluidically independent of the second cooling device 270 and can have an additional second cooling fluid 285, or fluidic coupling of the two cooling devices 260, 270 is ensured by means of appropriate connections. By virtue of the structural arrangement, the second cooling device 270 serves, on the one hand, to cool the exhaust gas stream 120 and also to reduce the thermal stress imposed on the actuator system 200 by the exhaust gas stream 120 since the second cooling device 270 is arranged between the exhaust gas stream 120 and the actuator system 200.

The invention claimed is:

1. An emission signature modification device for modification of an acoustic signature of an exhaust gas stream, comprising: an exhaust gas guiding device that guides the exhaust gas stream in a flow direction from an inlet region to an outlet region; and an active acoustic emission modification device, that modifies an acoustic emission of the exhaust gas stream in predetermined operating states, wherein the active acoustic emission modification device includes an actuator system, wherein more than 30% of the actuator system is surrounded in a circumferential direction by the guided exhaust gas stream, wherein the exhaust gas guiding device has an outer shell with a solid outer circumferential wall, wherein the exhaust gas guiding device includes an inner shell, wherein the exhaust gas stream is guided at least partially between the outer shell and the inner shell of the exhaust gas guiding device; and a heat emission modification device that modifies heat emission of the exhaust gas stream in predetermined operating states, wherein the heat emission modification device comprises a first cooling device having a first cooling fluid, wherein the first cooling device is completely within the outer circumferential wall of the outer shell and is formed at least partially by the outer shell so that the first cooling fluid flows through the outer shell.

2. The emission signature modification device according to claim 1, wherein the inner shell has an extent that amounts to at least 1% of an extent of the outer shell in the flow direction.

3. The emission signature modification B device according to claim 1, further comprising at least one component arranged within the outer shell to guide the exhaust gas stream.

4. The emission signature modification device according to claim 1, wherein the outlet region has a cross-sectional area perpendicular to the flow direction that is 90% smaller than a central cross-sectional area of the emission signature modification device perpendicular to the flow direction.

5. The emission signature modification device according to claim 1, wherein the emission signature modification device is designed for modification of a heat signature of the exhaust gas stream.

6. The emission signature modification device according to claim 1, further comprising a second cooling device having a second cooling fluid by which the actuator system is cooled.

7. The emission signature modification device according to claim 6, wherein the first cooling device is fluidically connected to the second cooling device.

8. The emission signature modification device according to claim 1, wherein the active acoustic emission modification device includes an acoustic diaphragm driven by the actuator system, wherein the acoustic diaphragm is water-resistant.

9. The emission signature modification device according to claim 8, wherein the acoustic diaphragm is seawater-resistant.

10. The emission signature modification device according to claim 1, wherein the emission signature modification device is a separate subassembly, which, in the flow direction, is positionable centrally or at an end in an exhaust section.

* * * * *